United States Patent [19]

Soderlund et al.

[11] 4,032,290

[45] June 28, 1977

[54] HIGH TEMPERATURE FURNACE MUFFLE

[75] Inventors: Martin I. Soderlund, Westborough; R. Chester Pray, Acton, both of Mass.

[73] Assignee: BTU Engineering Corporation, North Billerica, Mass.

[22] Filed: May 24, 1976

[21] Appl. No.: 689,554

[52] U.S. Cl. ..... 432/200; 432/208; 432/242

[51] Int. Cl.[2] ..... F27B 5/18; F27B 5/02

[58] Field of Search ..... 432/200, 242, 208; 34/242

[56] References Cited

UNITED STATES PATENTS 3,625,496 12/1971 Bornor ..... 432/242

FOREIGN PATENTS OR APPLICATIONS 1,384,063 2/1971 United Kingdom ..... 432/200

*Primary Examiner*—John J. Camby

*Attorney, Agent, or Firm*—Weingarten, Maxham & Schurgin

[57] ABSTRACT

A muffle seal for a high temperature furnace in which a quartz or similar muffle is attached to an associated metal structure to provide substantial sealing of gas in the muffle even at extremely high operating temperatures. As employed in a multi-zone furnace having a high temperature quartz muffle section and a lower temperature metal muffle section joined thereto via a gas or gas and heat barrier, the quartz muffle is joined to the barrier by a peripheral chamber provided around the end of the quartz muffle confronting the barrier, the chamber being sealed to surfaces of the muffle and the barrier by porous gaskets. A sealing gas is introduced at above atmospheric pressure to the peripheral chamber, the gas being controllably transmitted through the porous gaskets to provide isolation against leakage of gas within the quartz muffle. The novel seal can also be employed to join quartz and metal muffle sections without a barrier therebetween.

10 Claims, 2 Drawing Figures

HIGH TEMPERATURE FURNACE MUFFLE

FIELD OF THE INVENTION

This invention relates to furnaces and more particularly to high temperature precision furnaces for the heat processing of products and materials.

BACKGROUND OF THE INVENTION

High temperature precision furnaces for the heat processing of products and materials often employ a furnace muffle formed of quartz which can withstand the extremely high operating temperatures. In a multizone furnace in which different temperatures and/or gases can be maintained, a barrier is provided between adjacent furnace sections to maintain distinct gas environments in the adjacent zones or to alternatively or additionally maintain a predetermined temperature profile between adjacent zones. The barrier is constructed of metal and must be sealed to the quartz muffle to prevent gas leakage from the muffle interior, which leakage can adversely affect the composition of the environment to be maintained within the muffle. In addition, in the case of toxic, volatile or explosive gases, leakage from the muffle can lead to disasterous consequences. The sealing of the quartz muffle to the metal barrier cannot be easily accomplished by reason of the relatively large difference in the thermal coefficients of expansion of the materials. In addition, known glass to metal sealing techniques are not practical by reason of the relatively large area to be sealed and the extremely high operating tempertures at which the seal must remain intact. In furnaces of known construction, seals known as cold seals such as spring loaded rubber gaskets have been provided in housings outside of the muffle but such cold seals cannot be employed at high operating tempertures, say in the vincinty of 600° C.

SUMMARY OF THE INVENTION

In brief, the present invention provides a high temperature furnace in which a quartz or similar muffle attached to an associated metal structure to provide substantial sealing of gas in a muffle even at extremely high operating temperatures. In a preferred embodiment, the invention is employed in a multizone furance having a high temperature quartz muffle section and a lower temperature metal muffle section with gas, heat, or gas and heat barrier interconnecting the adjacent sections. A peripheral chamber is provided around the end of the quartz muffle containing the barrier, the chamber being sealed to surfaces of the muffle and the barrier by ceramic fiber or other gaskets which are porous to an intended degree. A neutral sealing gas is introduced at above atmospheric pressure to the peripheral chamber, this gas being controllably transmitted through the gaskets to provide a gas barrier preventing leakage of gas within the quartz muffle. The novel seal is not limited to use in furnaces having a barrier between furnace sections. Rather, the invention is broadly useful in sealing a quartz or other similar muffle directly to a metal muffle or to another metal structure.

DESCRIPTION OF THE DRAWINGS

The invention will be more fully understood from the following detailed description taken in conjunction with the accompanying drawings in which.

DETAILED DESCRIPTION OF THE INVENTION

Figure 1:
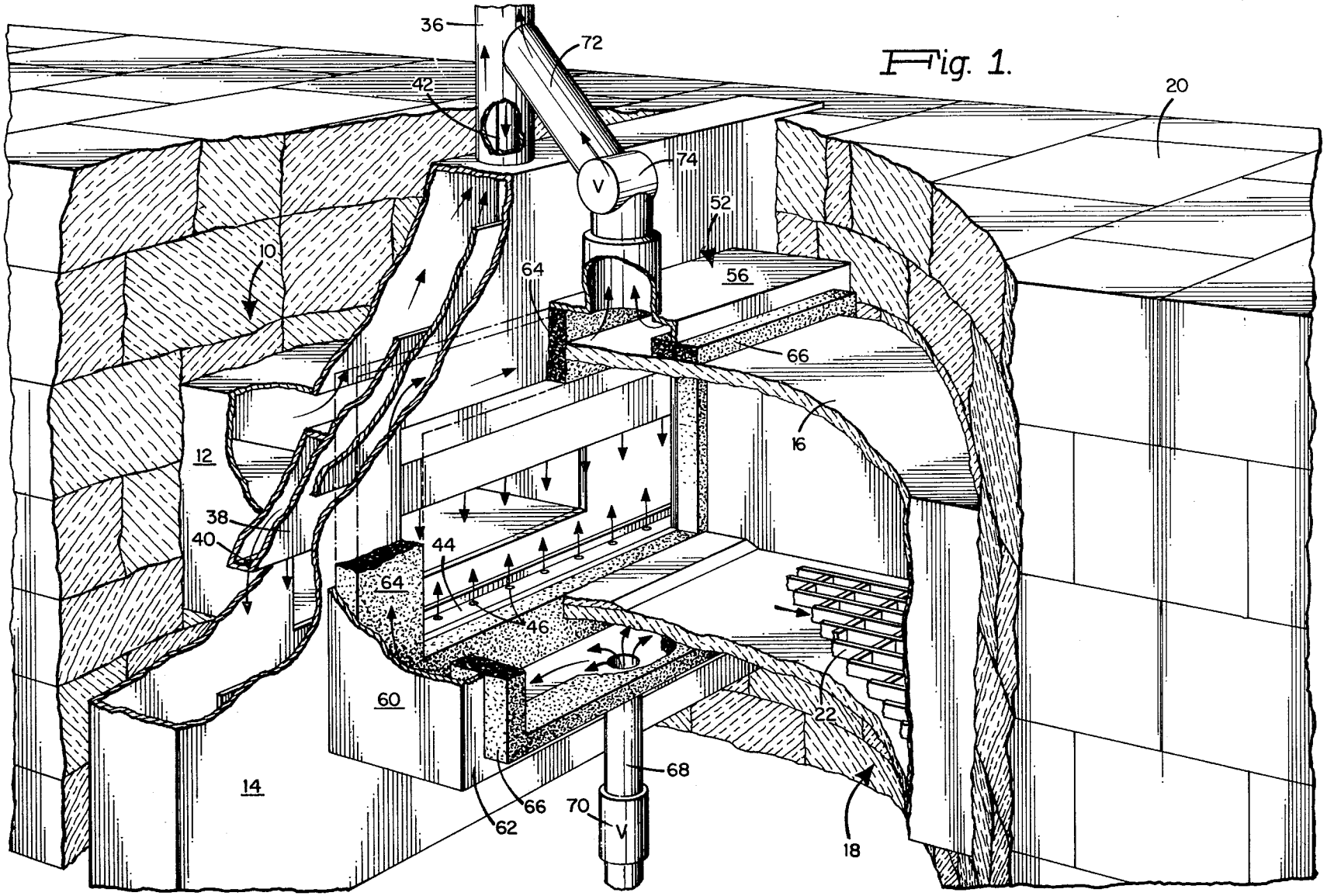
FIG. 1 is a partially cutaway pictorial view of a high temperature furnace embodying the invention.
Figure 2:
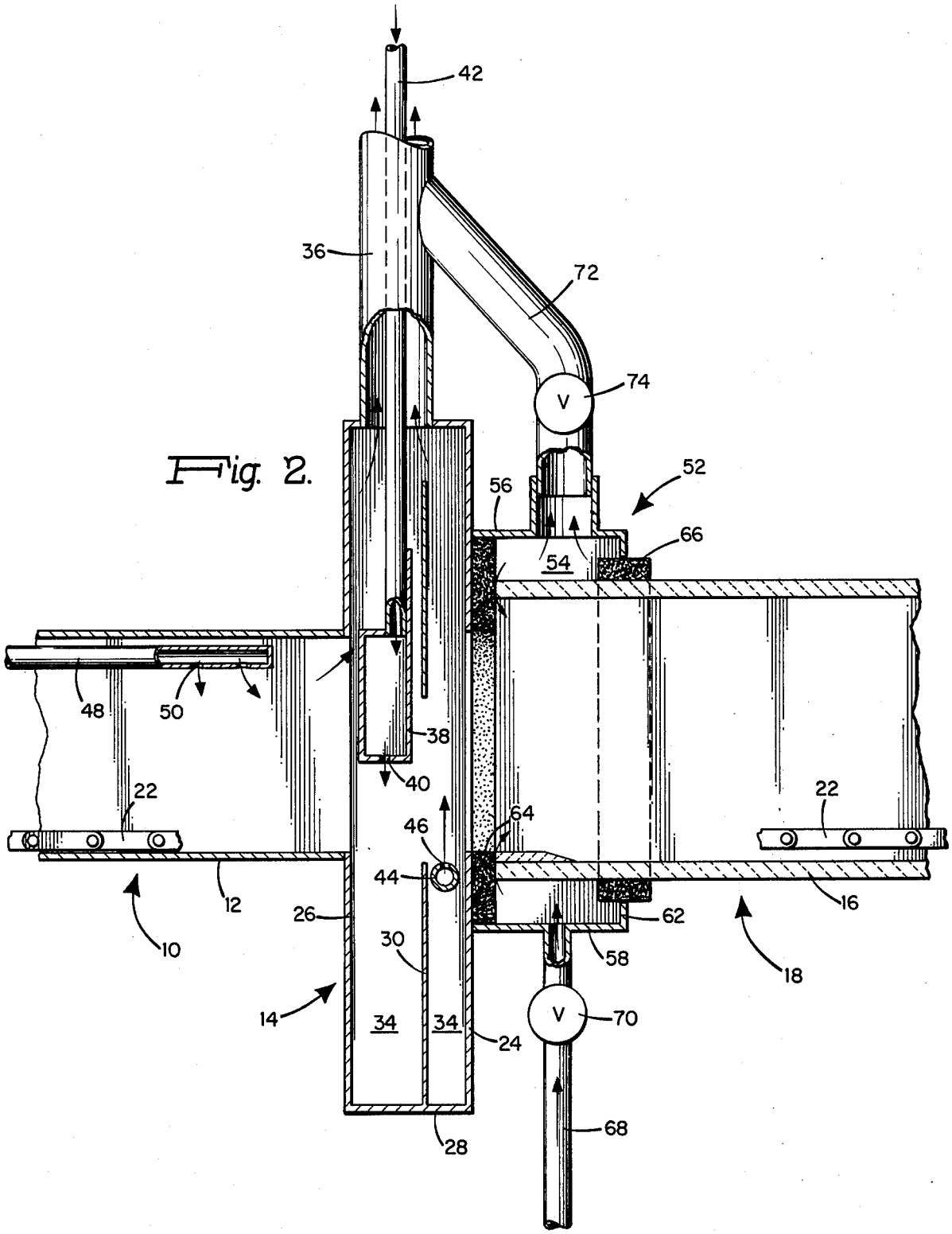
FIG. 2 is sectional elevational view of the embodiment of FIG. 1.

Referring to FIG. 1 and 2 there is shown a high temperature furnace according to the invention and comprising a lower temperature section 10 having a metal muffle 12, joined to one side of a heat and gas barrier 14, at the opposite side of which is joined a quartz muffle 16 of a higher temperature furnace section 18. The adjacent furnace muffles 12 and 16 define a furnace chamber having respective zones in which different gas environments can be maintained as well as different operating temperatures. A high temperature refractory material typically in the form of firebrick 20 encloses the furnace muffles and provides insulation therefor. A conveyor belt 22 of high temperature metal is disposed along the floor of muffles 12 and 16 and is part of an endless loop conveyor mechanism (not shown) for transport of a work product through the furnace chamber. Heaters are employed in the respective muffles 12 and 16 for establishing predetermined temperatures therein. The heating elements can be of known construction and are not shown. The furnace section 10 is usually a preheat section operative in a typical temperature of 400° to 600° C. High temperature heat processing is accomplished in the furnace section 18 which is typically operative in the temperature range of 800° to 1100° C.

The heat and gas barrier 14 is operative in known manner to provide a predetermined temperature profile between adjacent furnace sections and to maintain respective gas environments in the furnace sections. The barrier includes a rectangular or round housing composed of a plate 24 confronting quartz muffle 16, a plate 26 confronting metal muffle 12, and top, bottom and side plates 28 welded or otherwise joined to the plates 24 and 26 to form an enclosed barrier chamber. The plates 24 and 26 include openings in alignment with the associated furnace muffles through which the work product is conveyed by conveyor 22. A plate 30 is disposed intermediate plates 24 and 26 and extending across the width of the barrier to divide the barrier into chambers 32 and 34. These chambers 32 and 34 merge at the upper portion of barrier 14 and to which is coupled an exhaust pipe 36 which is coupled to suitable exhaust apparatus.

An enlongated gas gate is disposed across the width of an upper portion of barrier chamber 34 above conveyor 22 and having a plurality of openings 40 in the bottom wall thereof for flow of a gas downward into the barrier. Gas is supplied to gate 38 by means of a supply pipe 42 coaxially disposed in exhause pipe 36. A gas gate 44 is also provided across the width of barrier chamber 32 below the plane of conveyor 22 and containing an array of openings 46 from which a gas is caused to upwardly flow through chamber 32 of the barrier. Gas is supplied to gate 44 via a tube entering the top of the barrier and extending downwardly through chamber 32 to the gate 44. A gas supply pipe 48 is disposed in the upper portion of muffle 12 having openings 50 by which gas is supplied to this muffle section.

A housing 52 is provided around the end of quartz muffle 16 adjacent to barrier 14 to define a peripheral chamber 54. Housing 52 includes a top wall 56, bottom wall 58, side walls 60 and an end wall 62. The walls are integrally formed or welded to provide the closed housing and the housing is welded to plate 24 of barrier 14. A porous gasket 64 of ceramic fiber material is disposed in chamber 54 confronting plate 24 and in sealed butting relationship between this plate and the end of quartz muffle 16. A gasket 66 of the same material as gasket 64 is disposed around muffle 16 in sealed butting relationship with the confronting edge of wall 62 of housing 52. The gaskets 64 and 66 are capable of withstanding the high operating temperature of the furnace and are porous to an intended degree to provide controlled leakage of a neutral sealing gas from the peripheral chamber 54. A supply pipe 68 is coupled via a valve 70 to the lower portion of housing 52 while an exhaust pipe 62 coupled the upper portion of housing 52 to exhaust pipe 36. A valve 74 is provided in exhaust pipe 72 for adjusting the flow rate of sealing gas from chamber 54.

In operation, a predetermined gas, such as air, is introduced via supply pipe 48 into muffle 12 of preheat section 10, while a forming gas or other suitable gas environment is provided within quartz muffle 16 of high temperature section 18. By operation of barrier 14 the gas environments of respective sections 10 and 18 are maintained isolated from each other. A non-reactive gas such as nitrogen is introduced to supply pipe 42 to provide a gas curtain from openings 40 of gate 38 which flows downwardly into chamber 34. A nitrogen or other non-reactive gas curtain is also provided by pipe 44 which produces an upward nitrogen flow in barrier chamber 32. The gas in muffle 12 is drawn along with nitrogen from gate 38 through the barrier to exhaust pipe 36. Similarly, the gas in muffle 16 is drawn along with nitrogen from pipe 44 through barrier chamber 32 and thence into exhaust pipe 36. The respective gas environments of the adjacent muffle sections are substantially isolated from each other to prevent flow of the gas from one section into the adjacent section. In the event that one or both of the gases in the furnace sections are combustible, an igniter of well known form can be employed in associated with the exhaust apparatus to burn off potentially dangerous gases.

A sealing gas, also typically nitrogen, is introduced by supply pipe 68 into chamber 54 at a pressure controllable by valve 70 and which is above atmospheric pressure. This sealing gas is controllably exhausted to a degree determined by adjustment of valve 74 via pipe 72 which joins exhaust pipe 36. The sealing gas in chamber 54 also controllably flows through the porous gaskets 64 and 66. The gas transmitted through gasket 64 is drawn through barrier chamber 32 into exhaust pipe 36 and provides isolation of the gas in quartz muffle 16 to prevent leakage of the gas in muffle 16 between the end of the quartz muffle and the confronting barrier. Since the housing 58 cannot be directly sealed hermetically to the quartz muffle, the gasket 66 is of no consequence since the sealing gas is neutral or non-reactive. The gaskets 64 and 66 are formed of ceramic fiber and silica and each is typically formed as a wet pack which is then dried out to provide the intended gasketing structure. The muffle 12, barrier 14 and housing 52 are fabricated typically of Inconel.

It will be appreciated that the quartz muffle 16 is effectively sealed to the barrier 14, and gas maintained in muffle 16 cannot leak between the end of the muffle and barrier 14, since the controlled leakage of sealing gas from peripheral chamber 54 through gaskset 64 into barrier chamber 32 prevents flow of gas in muffle 16 through gasket 64. The degree of flow of sealing gas through the gaskets 64 and 66 is determined in accordance with the pressure of the gas within muffle 16 and the degree of controlled leakage of the sealing gas is provided by valves 70 and 74 taking into account the sealing gas supply pressure, the exhaust pressure and the porosity of gaskets 64 and 66.

The invention is not limited to use only in the particular furnace illustrated. Rather, the novel muffle seal is broadly useful in joining in a gas seal manner a quartz or similar muffle to a metal muffle or other metal structure of the furnace. The invention finds application in sealing adjacent components of a high temperature furnace, such as metal and quartz muffle sections, which exhibit relatively large differences in thermal coefficients of expansion. Accordingly, the invention is not to be limited by what has been particularly shown and described, except as indicated in the appended claims.

What is claimed is:

1. A high temperature furnace comprising:

a first furnace section having a metal muffle;

a second furnace section having a quartz muffle and disposed adjacent to said first section;

sealing means surrounding an end of said quartz muffle confronting said metal muffle and including a peripheral chamber joined to the quartz muffle and to a confronting surface of said metal muffle by porous gasket means; and means coupled to said peripheral chamber and operative to introduce sealing gas at predetermined pressure into the peripheral chamber to cause controlled leakage of the sealing gas from said chamber through the porous gasket means to prevent leakage of gas in the quartz muffle.

2. A high temperature furnace comprising:

a first furnace section operative at a predetermined temperature and having a metal muffle;

a second furnace section operative at a predetermined temperature and having a quartz muffle disposed adjacent said first section;

a barrier between said first and second furance sections operative to isolate the environments in each of said sections;

sealing means surrounding an end of said quartz muffle confronting the barrier and defining a peripheral chamber and including porous gasket means sealing said peripheral chamber to the quartz muffle and to the barrier; and means coupled to said peripheral chamber and operative to introduce sealing gas at predetermined pressure into the peripheral chamber to cause controlled leakage of the sealing gas from the peripheral chamber through the porous gasket means to prevent leakage of gas in the quartz muffle.

3. The high temperature furnace of claim 2 wherein said sealing means includes:

a metal housing around an end of said quartz muffle confronting the barrier and defining said peripheral chamber;

a first porous gasket interposed in sealing butting relationshop between the end of the quartz muffle and confronting surface of said barrier; and a second porous gasket in sealing butting relationship between a wall of said metal housing and confronting outer surface of the quartz muffle.

4. The high temperature of claim 2 wherein said sealing means includes:

a metal housing around an end of said quartz muffle confronting the barrier and defining said peripheral chamber and having one or more walls spaced from the outer surface of the quartz muffle and an end wall joined to said one or more walls and spaced from the barrier;

a first porous gasket interposed in sealing butting relationship between the end of the quartz muffle and confronting surface of the barrier; and a second porous gasket in sealed butting relationship between said end wall and confronting outer surface of the quartz muffle.

5. The high temperature furnace of claim 4 wherein said means coupled to said peripheral chamber includes:

a supply pipe adapted for connection to a supply of sealing gas to introduce sealing gas into said peripheral chamber at a predetermined pressure.

6. The high temperature furnace of claim 3 wherein said first and second porous gaskets are composed of ceramic fiber porous to a predetermined degree.

7. The high temperature furnace of claim 3 wherein said barrier is a gas barrier and said first and second furnace sections have respective gas environments maintained therein and isolated by said barrier.

8. For use in a high temperature furnace having a muffle defining a furnace chamber and being of a material having a thermal coefficient of expansion different that that of metal, means for effectively sealing said muffle to an adjacent metal structure of said furance comprising:

a peripheral chamber surrounding an end to said muffle;

porous gasket means disposed between an end of said muffle and a confronting surface to said metal structure; and means coupled to said peripheral chamber and operative to introduce sealing gas therein at predetermined pressure to cause controlled leakage of the sealing gas from the peripheral chamber through the porous gasket means.

9. The invention of claim 8 wherein said peripheral chamber includes:

a metal housing around an end of said muffle confronting said metal structure and defining said peripheral chamber.

10. The invention of claim 9 wherein said metal housing includes:

one or more walls spaced from the outer surface of said muffle and joined to said metal structure and an end wall joined to said one or more walls and spaced from said metal structure; and wherein said porous gasket means includes:

a first porous gasket interposed in sealed butting relationship between an end of said muffle and a confronting surface of said metal structure; and a second porous gasket in sealed butting relationship between said end wall and the confronting outer surface of said muffle.

* * * * *

UNITED STATES PATENT OFFICE

CERTIFICATE OF CORRECTION

PATENT NO. : 4,032,290

DATED : June 28, 1977

INVENTOR(S) : Martin I. Soderlund and R. Chester Pray

It is certified that error appears in the above-identified patent and that said Letters Patent are hereby corrected as shown below:

Column 1, line 32, "tempertures" should read --temperatures--;
line 42, after "muffle" insert --is--; and
line 51, "containing" should read --confronting--.
Column 2, line 28, after "temperature" insert --range --.
Column 3, line 42, "associated" should read --association--;and
line 68, "gaskset" should read --gasket--.
Column 5, line 1, after "temperature" insert --furnace--.
Column 6, line 3, "to" should read --of--; and
line 6, "to" should read --of--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*